US005565648A

United States Patent [19]

Lindstädt et al.

[11] Patent Number: 5,565,648

[45] Date of Patent: Oct. 15, 1996

[54] FRAGMENTATION CASING FOR A SECONDARY PROJECTILE OF A TANDEM WARHEAD

[75] Inventors: Klaus Lindstädt, Schwaig; Manfred Klare, Simmelsdorf, both of Germany

[73] Assignee: Diehl GmbH & Co., Nürnberg, Germany

[21] Appl. No.: 540,933

[22] Filed: Oct. 11, 1995

[30] Foreign Application Priority Data

Sep. 15, 1995 [DE] Germany ..... 195 34 215.1

[51] Int. Cl.[6] ..... F42B 12/32

[52] U.S. Cl. ..... 102/478; 102/476; 102/496; 102/499

[58] Field of Search ..... 102/308, 389, 102/473, 476, 478, 491–497, 499

[56] References Cited

U.S. PATENT DOCUMENTS

| | | | |
|---|---|---|---|
| 94,647 | 9/1869 | Richards | 102/478 |
| 4,296,180 | 10/1981 | Rhau et al. | 102/496 |
| 4,450,124 | 5/1984 | Christmann et al. | 264/3 |
| 4,803,928 | 2/1989 | Kramer et al. | 102/476 |

FOREIGN PATENT DOCUMENTS

| | | | |
|---|---|---|---|
| 2149078 | 3/1973 | France | 102/494 |
| 48043 | 8/1889 | Germany | 102/497 |
| 317581 | 12/1919 | Germany | 102/494 |
| 3424238 | 1/1986 | Germany | 102/493 |
| 3941445 | 6/1991 | Germany | 102/496 |
| 113414 | 3/1945 | Sweden | 102/478 |

*Primary Examiner*—Harold J. Tudor
*Attorney, Agent, or Firm*—Scully, Scott, Murphy & Presser

[57] ABSTRACT

A fragmentation casing for a secondary projectile of a tandem warhead which includes a forwardly located active charge, a rearwardly located active charge and a fuze arranged between the charges. The secondary projectile possesses on both sides thereof a generally ovoid, thick-walled and uniformly thick nose cone with a heavy wall thickness and with an inwardly located separate fragment charge; a one-sided overhung fastening of a fuze through a collar extending between two housing parts of the secondary projectile, whereby the fuze is almost completely and; in essence, also around the periphery thereof, embedded in the explosive of the rearwardly located active charge, and with a gapless arrangement of the interconnected active charges, the casing, the prefinished fragments and the nose cones.

9 Claims, 1 Drawing Sheet

FRAGMENTATION CASING FOR A SECONDARY PROJECTILE OF A TANDEM WARHEAD

BACKGROUND OF THE INVENTION

1. Field of the Invention

The present invention relates to a fragmentation casing for a secondary projectile of a tandem warhead which includes a forwardly located active charge, a rearwardly located active charge and a fuze arranged between the charges.

2. Discussion of the Prior Art

Pursuant to the disclosure of U.S. Pat. No. 5,198,615, there is already presently known a tandem warhead including a hollow charge which is located towards the head or leading end thereof, and a rearwardly located secondary projectile. The hollow charge has the task to create a through-passageway in a covering for the following secondary projectile. After the egress of the secondary projectile from the through-passageway, the secondary projectile disintegrates with a fragmentation effect. The fragmentation effect is caused through the detonative disintegration of the projectile casing.

A fragmentation effect which is enhanced in comparison with the above-mentioned is produced through the structure as disclosed in German Laid-Open Patent Application No. DE A1 39 41 445. An infantry grenade possesses prefinished fragments at its forward and rearward sides in its nose cones. The fragments are arranged on the outsides of the nose cones. Consequently, there is no tendency for its suitability as a secondary projectile with a capability of penetrating a through-passageway in an undamaged manner, inasmuch as there is encountered the danger that during its travel through the passageway the fragment casing or packaging will be destroyed. On the other hand, the fragment casing is destroyed through the effects of the gases from the explosives of the forwardly located hollow charge.

SUMMARY OF THE INVENTION

Accordingly, it is an object of the present invention to provide an operationally-reliable secondary projectile of a tandem warhead with an enhanced fragmentation effect, whereby the secondary projectile remains uninfluenced by the stresses encountered after the triggering of the hollow charge due to the effects of the gases from the explosives, as well as also being able to withstand the stresses encountered during passage through the through-passageway.

The foregoing object is attained in that the secondary projectile possesses on both sides thereof a generally ovoid, thick-walled and uniformly thick nose cone with a heavy wall thickness and with an inwardly located separate fragment charge; a one-sided overhung fastening of a fuze through a collar extending between two housing parts of the secondary projectile, whereby the fuze is almost completely and; in essence, also around the periphery thereof, embedded in the explosive of the rearwardly located active charge, and with a gapless arrangement of the interconnected active charges, the casing, the prefinished fragments and the nose cones.

Further advantageous embodiments of the invention may be readily ascertained from the following detailed description as set forth hereinbelow.

Inventively, there is present a so-called hardened secondary projectile; consequently, there is no necessity in having to provide any separate protective devices located in front of the secondary projectile against the effects of the gases from the explosives of the forwardly located hollow charge. On the other hand, the fragmentation effect is substantially increased in comparison with that of the current state of the technology, inasmuch as the fragments gaplessly lie against the projectile casing; and namely, under a prestressing. The rounded-off shape of the two nose cones produces a large density of the fragments for each spatial angular sector at a high fragmentation energy. During the passage of the secondary projectile through the through-passageway, the shape of the forward nose cone facilitates a threading into the through-passageway without any problems or, respectively, into the crater of the through-passageway facing the side of the target. The solid and uniformly thick nose cone also affords that in the event any obstructions are encountered in the through-passageways, such as the remains of armor, these are displaced by being pushed towards the side.

BRIEF DESCRIPTION OF THE DRAWINGS

Reference may now be had to the following detailed description of an exemplary embodiment of an invention, taken in conjunction with the accompanying drawings; in which.

DETAILED DESCRIPTION OF A PREFERRED EMBODIMENT

Figure 1:
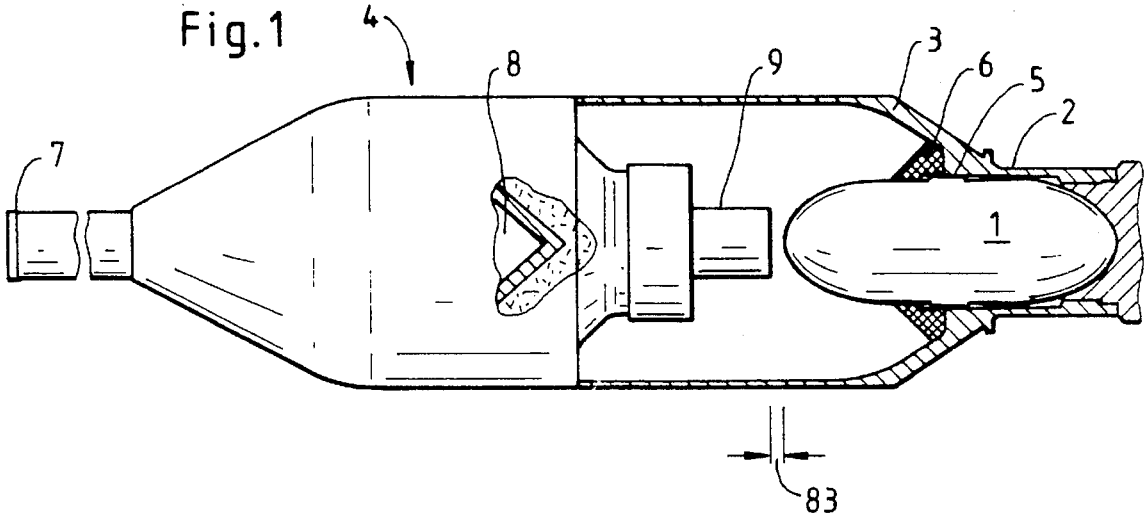
FIG. 1 illustrates a longitudinal sectional view through a tandem warhead.
Figure 2:
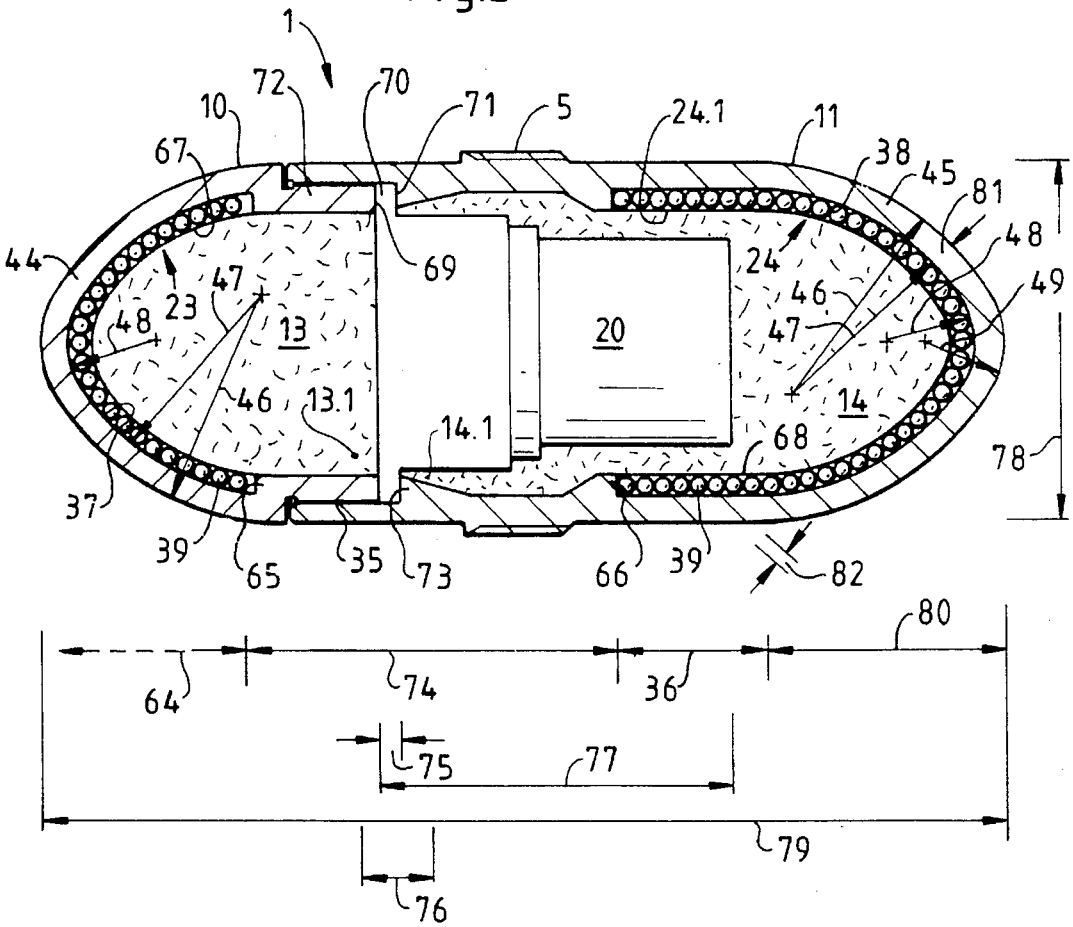
FIG. 2 illustrates, on an enlarged scale, a longitudinal sectional view through a secondary projectile pursuant to FIG. 1.

According to FIG. 1, a secondary projectile 1 is supported in a tubular section 2 of a housing 3 of a tandem warhead 4, and is connected through a screwthreaded connection 5 with the housing 3. A protector against gases from explosives is designated with reference numeral 6.

The forward part of the tandem warhead 4 possesses a proximity fuze 7 and a hollow charge 8 with a fuze 9.

The secondary projectile 1 consists of two housing parts 10, 11 which are screwed together by means of a screwthreaded connection 35. Arranged on the housing parts 10, 11 are nose cones 44, 45. The nose cones 44, 45 are mutually constructed as mirror images, and with respect to their external and internal contours, consist of a total of four circular arcs in accordance with the radii 46 through 49. The thickness of the nose cones is uniformly thick along each curvilinear section, whereby a cylindrical section 36 is similarly provided with this thickness.

Both nose cones 44, 45 each possess on their respective inner walls 37, 38 a fragmentation charge 23, 24 consisting of prefinished fragments 39. The fragmentation charge 24 extends within the rearward housing part 11 also over the cylindrical section 36, and is identified therein by reference numeral 24.1.

The fragmentation charges 23, 24 are bounded by steps 65, 66 on the housing parts 10, 11, and are covered by casings 67, 68 against active charges 13, 14 which are constituted of explosives.

A fuze 20 separates the two active charges 13, 14 from each other, whereby the fuze 20 is fixedly clamped in through the two housing parts 10, 11 at locations 69 and 71.

The active charges 13, 14 are pressed under a high compressive pressure against the casings 67, 68 and the fragmentation charges 23, 24 within the housing parts 10, 11. As a result thereof, the fragments 39 lie gaplessly against the inner wall surfaces 37, 38 of the housing parts 10, 11, whereby the casings 67, 68 in the region of the fragments 39 evidence cup-shaped depressions due to the high compressive force. As a result, there is also formed a gapless arrangement between the active charges 13, 14 and the casings 67, 68, as well as between the casings 67, 68 and the fragments 39.

Upon the tandem warhead 4 striking against an enemy covering (not shown), there is produced through the intermediary of the hollow charge 8 a crater with a therewith connected through-passageway in the covering. The secondary projectile which has been released from the housing 3 penetrates through the crater and the through-passageway with its forward nose cone 44. Any eventually encountered oscillations or hunting movement with the therewith connected angled impacting of the secondary projectile 1 in the crater of the through-passageway do not exert any disadvantageous influence over the threading-in process. The shape of the forward nose cone 44 facilitates, in every instance, the threading-in process. Moreover, during the passage of the secondary projectile 1 through the through-passageway, there are restrained any wall contacts. Additionally, the ogive or rounded shape of the nose cone 44 causes that any obstructions encountered in the through-passageway, such as remains of armoring consisting of steel, are displaced towards the side.

After a certain delay period, the fuze 20 simultaneously ignites the active charges 13, 14. As a result, there is achieved that in the immediate region of the rear side of the enemy covering there is attained an extensive fragmentation effect. Especially is this achieved by means of the rear active charge 14, in that there is provided herein a substantially larger fragment charge 24, 24.1 than in the forwardly located active charge 13.

Essential for the fragment orientation and the quantity of fragments for each angular spatial sector, are the external and internal contours of the nose cones 44, 45 based on the circular arc-formed curvilinear sectors as having reference to the radii 46 through 49.

The fragmentation effect combines itself from the fragments of the housing parts 10, 11 and from the fragments 39 of the fragmentation charges 23, 24.

Investigations have also evidenced that upon the detonation of the hollow charge 8, the parts of the fuze 9 which strike against the nose cone 44 lead neither to any damage of the nose cone 44 nor do they influence the functioning of the active charges 13, 14 inclusive of the fuze 20. This is because, from the construction of the secondary projectile 1, there results a so-called "hardened" structure. Due to this fact, it is not necessary to provide any additional protective devices for the deflection of the gases from the explosives between the fuze 9 and the secondary projectile 1. In contrast, it is possible to arrange the secondary projectile 1 immediately behind the fuze 9 at a short spacing 83.

A large portion of the insensitivity of the secondary projectile 1 is due to the special ovoid shape of the nose cone 44. It fulfills a quadruple function, as follows:

1. Gases generated from the explosives of the hollow charge 8 and the parts of the fuze 9 are deflected upon the detonation of the hollow charge 8.
2. The shape of the nose cone affords the threading-in process into the crater of the through-passageway.
3. The shape of the nose cone stabilizes the travel of the secondary projectile 1 through the through-passageway, whereby any eventually encountered obstructions are displaced towards the side.
4. There is present an optimized fragmentation effect, especially with regard to the rear active charge 14.

At an egress from the through-passageway which is not coaxial; in effect, at an angled position or at a cross-wise position of the secondary projectile 1, the fragmentation effect of the rear active charge 14 is only partially effective in a direction towards the wall of the covering which has been pierced. Due to the two ovoid nose cones 43, 44 and the almost through-extending explosive over the entire projectile length of the secondary projectile 1; in effect, especially also over almost the entire triggering length, added to the fragmentation effect of the rear active charge 14 which is only partly effective, are also fragment portions of the housing sections 10, 11; namely, the segment 74 between the fragmentation charges 23 and 24 and a thereto connecting section 64 of the forwardly located fragmentation charge 23 including a housing part. Consequently, there is only obtained a narrow fragmentation region 75 due to the collar 70 of the fuze 20 with a reduced quantity of fragments. From this region 75, which does not possess any explosives, because of the adjoining explosive quantities 13.1, 14.1, there results a fragment region 76 with a lower fragment density.

The insensitivity of the fuze 20 upon the detonation of the hollow charge 8 and also upon the striking of the secondary projectile 1 in the crater of the through-passageway, and finally the shocks encountered during the passage of the secondary projectile 1 through the through-passageway is based, on the one hand, on respectively the "overlying" supports, or respectively, the fastening of the fuze 20 in the secondary projectile 1. The collar 70 represents the single fasting location for the fuze 20 in its connection to the housing parts 10, 11. In the axial direction of the secondary projectile there is present only narrow support surfaces due to the connectors 72, 73 of the housing parts 10, 11. This signifies that shock waves encountered due to the detonation of the hollow charge 8 are also transmitted to the fuze 20 as shocks or jarrings upon striking in the crater of the through-passageway, or respectively, as shocks during the passage of the secondary projectile 1 through the through-passageway, only to a minor extent. As a result, there are not encountered any kind of disturbances to the fuze, and there is ensured a precise functioning of the fuze 20 just with respect to the correct point in time in the detonation at the rear side of the covering.

The already described effect of the specialized triggering positioning of the fuze 20 in the secondary projectile 1 is predicated in geometrical viewpoint on the short clamped-in length of the collar 70 from about 5 to 10% of the overall length 77 of the fuze 20, which is dependent upon the caliber size. At a caliber of 47 mm, the clamped-in length of the collar 70 is approximately 6%.

The diameter 78 of the secondary projectile 1 consists of about 33 to 40% of the overall length 79, whereby at the above-mentioned caliber, there is 37%. This ratio affords an extremely good free-flight characteristic which commences with the release of the secondary projectile 1 from the tubular section 2 of the tandem warhead 4; however, which is interrupted during the passage through the through-passageway of a covering, and terminates with a minimum path of movement at the rear side of the covering through the detonation of the secondary projectile 1.

An optimum in the fragment density and fragment energy is given through the length of the nose cones 44, 45 relative to the diameter 78 of the secondary projectile 1. This ratio consists of about 65 to 75%, whereby for the mentioned caliber size there is present a ratio of 70%.

The fragment yield or output of the secondary projectile combines itself from the prefinished fragments 39 and from the fragments of the housing parts 10, 11. Hereby, the thickness 82 of the prefinished fragments 39 in the direction of explosion is approximately 4.5 to 5% (in the instance of the caliber of 47 mm being 4.7%), and the thickness 81 of the nose cones 44, 45 in the direction of explosion (thickness of the fragments) approximately 7 to 8.5% of the diameter 78 of the secondary projectile (relative to the caliber being 7.8%).

The above-described functions of the secondary projectile 1 necessitate the use of a highly stressable material, and are afforded through a chromium nickel steel which is alloyed with molybdenum.

What is claimed is:

1. A secondary projectile for a tandem warhead; said secondary projectile comprising a cylindrical housing having a forward housing part and a rearward housing part joined to said forward housing part; said forward housing part having a leading end in the shape of a first generally ovoid nose cone of uniform wall thickness and said rearward housing part having a trailing end in the shape of a second generally ovoid nose cone of uniform wall thickness; a forwardly located explosive active charge in said forward housing part and in said first nose cone; a rearwardly located explosive active charge in said rearward housing part and in said second nose cone; fragmentation charges comprising prefinished fragments being located along interior surfaces of said nose cones and housing parts; casing means for retaining said fragmentation charges in position along said interior surfaces; and a fuze in said projectile; said fuze having a forward end thereof including an annular collar clampingly engaged between said forward and rearward housing parts so as to suspend said fuze substantially completely embedded in said rearwardly located explosive active charge and provide a gapless arrangement between said forward and rearward active charges, said casing means, said fragmentation charges and said nose cones.

2. A secondary projectile as claimed in claim 1, wherein said ovoid nose cones have configurations formed from a plurality of varying radii.

3. A secondary projectile as claimed in claim 1, wherein said annular collar extends radially outwardly at the forward end of said fuze, said collar being of a short axial length.

4. A secondary projectile as claimed in claim 3, wherein the clamped-in length of said collar between said housing parts comprises about 5% to 10% of the overall axial length of said fuze within said projectile housing.

5. A secondary projectile as claimed in claim 1, wherein the external cylindrical diameter of said secondary projectile housing is about 33% to 40% of the axial length of said secondary projectile.

6. A secondary projectile as claimed in claim 1, wherein the axial length of the nose cones consists of about 65% to 75% of the external cylindrical housing diameter of the secondary projectile.

7. A secondary projectile as claimed in claim 1, wherein the wall thickness of each of the nose cones consists of about 7% to 8.5% of the external cylindrical housing diameter of the secondary projectile.

8. A secondary projectile as claimed in claim 1, wherein the thickness of the fragments in the direction of explosion comprises about 4.5% to 5% of the diameter of the body of each fragment.

9. A secondary projectile as claimed in claim 1, wherein the housing parts of the secondary projectile are constituted of a chromium-nickel steel alloyed with molybdenum.

* * * * *